US005361713A

United States Patent [19]

Suzuki

[11] Patent Number: 5,361,713

[45] Date of Patent: Nov. 8, 1994

[54] WORK SHEET CUTTING BLADE WITH CONTINUOUS BLADE DISPLACEMENT DETECTION

[75] Inventor: Hiroyuki Suzuki, Kasugai, Japan

[73] Assignee: Brother Kogyo Kabushiki Kaisha, Nagoya, Japan

[21] Appl. No.: 996,045

[22] Filed: Dec. 23, 1992

[30] Foreign Application Priority Data

Feb. 5, 1992 [JP] Japan ..... 4-020128
Feb. 5, 1992 [JP] Japan ..... 4-020129

[51] Int. Cl.[5] ..... D05B 3/06

[52] U.S. Cl. ..... 112/68; 83/74; 83/905

[58] Field of Search ..... 112/65, 68, 66, 67, 112/129, 285, 293, 294, 300, 301; 83/72, 74, 905, 910, 921, 948

[56] References Cited

U.S. PATENT DOCUMENTS 4,271,768 6/1981 Goldbeck ..... 112/68
4,341,169 7/1982 Mainot et al. ..... 112/68 X
4,467,738 8/1984 Walther et al. ..... 112/129
4,517,908 5/1985 Park ..... 112/129
5,085,157 2/1992 Jung et al. ..... 112/68
5,085,157 2/1992 Jung et al. ..... 112/68

*Primary Examiner*—Clifford D. Crowder
*Assistant Examiner*—Ismael Izaguirre
*Attorney, Agent, or Firm*—Oliff & Berridge

[57] ABSTRACT

A work sheet cutting apparatus for cutting a work sheet, including a cutting member for cutting the work sheet, a support member on which the work sheet is to be received when the cutting member is cutting through the work sheet, an actuating device for displacing the cutting member along a predetermined path between an operative position of the cutting member where the cutting member is received by the support member and a retracted position of the cutting member spaced away from the operative position, and a detecting device for continuously detecting the displacement of the cutting member within a predetermined range included in the predetermined path, and generating continuous signals representing that the cutting member is displacing within the predetermined range.

16 Claims, 14 Drawing Sheets

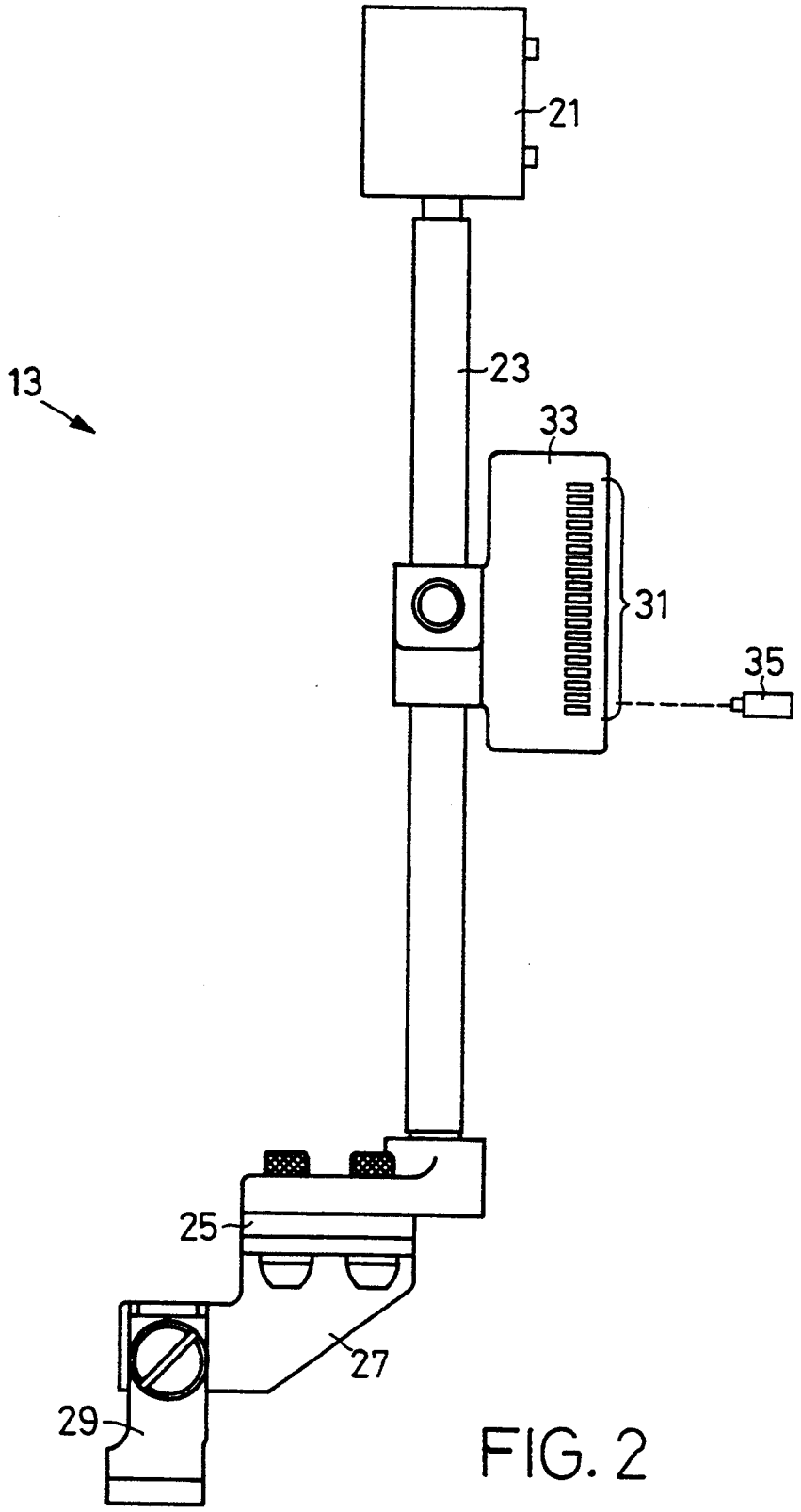
FIG. 2
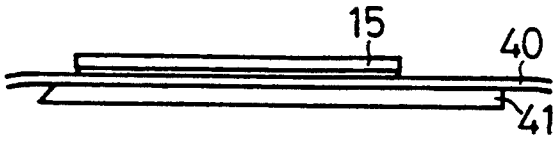

WORK SHEET CUTTING BLADE WITH CONTINUOUS BLADE DISPLACEMENT DETECTION

BACKGROUND OF INVENTION

1. Field of the Invention

The present invention relates to a work sheet cutting apparatus employed in, for example, a buttonhole sewing machine.

2. Related Art Statement

There is known a work sheet cutting device which includes (a) a cutting member, such as a cutting blade, for cutting a work sheet, such as a work cloth, (b) a support member on which the work sheet is to be received when the cutting member is cutting through the work sheet so as to form an opening or hole in the cloth, and (c) actuating means for displacing the cutting member along a predetermined path between an operative position of the cutting member where the cutting member is received by the support member and a retracted position of the cutting member spaced away from the operative position.

This cutting device is incorporated in, for example, a buttonhole sewing machine, for forming a button hole in a work cloth.

FIGS. 11 and 12 show a known cutting device employed in a buttonhole sewing machine. An actuator bar 103 to the lower end of which a cutting blade 101 is secured is displaced downward by an air cylinder 105 connected to the upper end of the actuator bar 103, so that the blade 101 is applied to a work cloth 107 set on a support member 109 and cooperates with the support 109 to cut through the cloth 107 and thereby form an opening serving as a button hole. A light-shading plate 113 is attached to the actuator bar 103, so that the plate 113 cooperates with a light detector 111 to identify that the cutting blade 101 is located at a predetermined position on its predetermined path between its operative position where the blade 101 is received by the support 109 and its retracted position spaced upward away from the operative position.

Upon operation of a start switch (not shown) provided on the sewing machine, the sewing machine automatically carries out a series of operations, first, forming buttonhole sewing stitches and, subsequently, opening a button hole in the middle of the formed stitches (cf. FIG. 9). FIG. 11 shows the cutting blade 101 or actuator bar 103 positioned at a height or level where the light-shading plate 113 prevents light from being incident to the light detector 111. When, from this position, the blade 101 or bar 103 is displaced downward by the air cylinder 105, the blade 101 will reach its operative position as shown in FIG. 12 where the blade 10i is received by the support 109 and cooperates with the support 109 to cut through the cloth 107. At the operative position of the blade 101, the light-shading plate 113 permits light to be incident to the light detector 111, so that the light detector 111 generates a "DETECTION" signal. The sewing machine identifies, upon generation of the "DETECTION" signal, that the work cloth cutting (or button hole opening) operation has been completed, and therefore supplies a "RETRACT" signal to the air cylinder 105 so as to start displacing the blade 101 upward toward its retracted position.

However, the above described cutting device suffers from some problems.

Since the cutting blade 101 is worn little by little because of use, it is necessary to sharpen or grind the blade 101 by removing it from the actuator bar 103. Thus, the blade 101 becomes shorter little by little. Unless the stoke of displacement of the blade 101 provided by the air cylinder 105 is adjusted or increased, the blade 101 will be unable to reach its operative position on the support 109, so that the blade 109 may fail to form a button hole in the work cloth 107. In the known cutting device, therefore, it is necessary to adjust the position of the light-shading plate 113 or the light detector 111 by a length equal to the shortened length of the blade 101. However, this adjustment is very cumbersome and time-consuming.

For avoiding the above indicated cumbersome adjustment, the stroke of displacement of the blade 101 provided by the air cylinder 105 may be pre-set at a more or less greater value, so that the air cylinder 105 continues to displace the blade 101 downward for a predetermined time duration even after the light detector 111 has generated a "DETECTION" signal. In this case, however, the blade 101 is pressed against the support 109 with excessively large force, which will lead to faster wearing of the blade 101 or even breaking the same 101. Therefore, this measure is not satisfactory.

FIGS. 13 and 14 shows a different known cutting device employed in a known buttonhole sewing machine. This cutting device has a construction basically similar to that of the above described known cutting device.

When a start switch (not shown) is operated on the known sewing machine, the sewing machine automatically carries out a series of operations, first, forming buttonhole sewing stitches, subsequently, opening a button hole in the middle of the formed stitches, and then, cutting a needle thread and a bobbin thread.

FIG. 14 shows a cutting blade 301 or actuator bar 303 located at its operative position where the blade 301 is pressed on a work cloth 307 and is received by a support member 309. If, in this condition, a needle-thread cutting device (not shown) is moved for cutting the needle thread, a pair of scissors of the needle-thread cutter device will however collide with the work sheet cutting device, in particular, cutting blade 301. Therefore, the sewing machine must not cause the needle-thread cutter device to start moving toward the needle thread at the time when the work cloth cutting (or button hole opening) operation has been completed in the condition shown in FIG. 14. Rather, when a light detector 311 detects a light-shading plate 313 and produces a "NON-DETECTION" signal indicating that the blade 301 has been displaced up to its retracted position (i.e., original position or upper limit position) by an air cylinder 305, as shown in FIG. 13, the sewing machine commands the pair of scissors of the needle-thread cutter device to start moving toward the needle thread.

Since this known sewing machine does not start moving the needle-thread cutter device until the cutting blade 301 is retracted to its retracted position, it needs a long cycle time to complete the above indicated series of operations.

However, if the cutting blade 301 has been displaced by a predetermined amount of distance from its operative position up to an intermediate position short of its retracted position, the interference of the blade 301 with other devices can be avoided. It is possible to detect, by adjusting the position of the light-shading plate 313 or light detector 311, that the blade 301 has been displaced to the above indicated "non-interference" position intermediate between the operative and retracted positions of the blade 301. Therefore, the sewing machine may be adapted to start moving the needle-thread cutter device at the time when the blade 301 is displaced up to the "non-interference" position. In this case, the cycle time is shortened. However, another problem remains.

As indicated previously, since the cutting blade 301 is worn little by little during use, it is necessary to sharpen or grind the blade 301 by removing it from the actuator bar 303. Thus, the blade 301 becomes shorter little by little. Unless the stoke of displacement of the blade 301 provided by the air cylinder 305 is adjusted or increased, the blade 301 will be unable to reach its operative position on the support 309, so that the blade 301 may fail to form a button hole in the work cloth 307. In the known cutting device, therefore, it is necessary to increase the stroke of downward displacement of the blade 301 provided by the air cylinder 305, by a length equal to the shortened length of the blade 301. For complying with this stroke adjustment, it will be necessary to adjust the position of the light-shading plate 313 or the light detector 311. Otherwise, the entire cycle time would be increased. However, this adjustment is very cumbersome and time-consuming.

SUMMARY OF THE INVENTION

It is therefore an object of the present invention to provide a work sheet cutting apparatus which is capable of continuously detecting the displacement of a cutting member such a cutting blade and, based on the detected displacement, controls the displacement of the cutting member with high reliability.

The above object has been achieved by the present invention, which provides a work sheet cutting apparatus for cutting a work sheet, comprising (A) a cutting member for cutting the work sheet, (B) a support member on which the work sheet is to be received when the cutting member is cutting through the work sheet, (C) actuating means for displacing the cutting member along a predetermined path between an operative position of the cutting-member where the cutting member is received by the support member and a retracted position of the cutting member spaced away from the operative position, and (D) detecting means for continuously detecting the displacement of the cutting member within a predetermined range included in the predetermined path, and generating continuous signals representing that the cutting member is displacing within the predetermined range.

In the work sheet cutting apparatus constructed as described above, the displacement of the cutting member such as a cutting blade within the predetermined range included in the predetermined path is continuously detected and, based on the detected displacement, the displacement of the cutting member is controlled with high reliability. The predetermined range may include the operative or retracted position of the cutting member, or may not include any of those positions of the cutting member. In the latter case, the predetermined range may be an intermediate range which is located between the operative and retracted positions of the cutting member and which is nearer to the operative position and, if a rate or speed of the detected displacement of the cutting member is found to be higher than a reference value, the displacement of the cutting member is so controlled as to be not higher than the reference value, so that the cutting member may not be pressed against the support member with excessively high pressing force, which may lead to faster wearing, or even breaking, the cutting member.

In a preferred embodiment of the present invention, the work sheet cutting apparatus further comprises first identifying means for identifying, based on the generated continuous signals, whether the displacement of the cutting member has been stopped at the operative position of the cutting member. In this embodiment, it is not necessary to carry out any cumbersome adjustment even if the cutting blade is sharpened or ground and consequently it is shortened. Since the stopping of the cutting member at the operative position thereof is detected with high reliability, the work sheet is assuredly cut to form an opening, without producing any additional problems.

In the above indicated, first embodiment of the present invention, the predetermined range including the operative position of the cutting member may be divided into a multiplicity of divided portions which are contiguous with each other, the detecting means comprising generating means for generating the continuous signals, the generating means generating, each time the cutting member enters each of the divided portions of the predetermined range while displacing toward the operative position along the predetermined path, a corresponding one of the continuous signals, the first identifying means comprising judging means for judging that the displacement of the cutting member has been stopped at the operative position, when the generating means does not generate the corresponding one signal for the each divided portion for a time duration predetermined for the each divided portion after the generating means has generated the signal for a backward adjacent divided portion out of the contiguous divided portions. The continuous signals may be pulse signals each of which takes a high level and subsequently takes a low level, each time the cutting member enters a corresponding one of the contiguous divided portions of the predetermined range of the predetermined path of the cutting member, or otherwise may be square-wave signals which alternately take a high and a low level each time the cutting member enters a new one of the contiguous divided portions.

In another embodiment of the present invention, the work sheet cutting apparatus further comprises second identifying means for identifying, based on the generated continuous signals, whether the cutting member has been displaced by a predetermined amount of distance from the operative position of the cutting member. In this embodiment, too, it is not necessary to carry out any cumbersome adjustment even if the cutting blade is sharpened or ground and consequently it is shortened. Since the displacement of the cutting member by the predetermined amount of distance is detected with high reliability, it is possible to, for example, assuredly avoid the cutting member from interfering with other devices movable for carrying out various operations on the work sheet.

In the above indicated, second embodiment of the present invention, the predetermined range including the operative position of the cutting member may be divided into a multiplicity of divided portions which are contiguous with each other, the detecting means comprising generating means for generating the continuous signals, the generating means generating, each time the cutting member enters each of the divided portions of the predetermined range while displacing from the operative position along the predetermined path, a corresponding one of the continuous signals, the second identifying means comprising judging means for judging that the cutting member has been displaced by the predetermined amount of distance from the operative position, when the generating means has generated a predetermined number of the continuous signals after the cutting member has started to displace from the operative position. The continuous signals may be pulse signals or square-wave signals as described above.

In the above indicated second embodiment, the work sheet cutting apparatus may further comprise at least one movable member which is movable along a second predetermined path intersecting the predetermined path of the cutting member as a first predetermined path, and inhibiting means for inhibiting the movable member from moving along the second predetermined path while the cutting member is positioned within the predetermined amount of distance from the operative position. In this case, the cutting apparatus may further comprise stitch forming means including a sewing needle, for forming stitches on the work sheet such as a work cloth, the at least one movable member comprising needle-thread cutting means for cutting a needle thread conveyed by the sewing needle. The inhibiting means permits the needle-thread cutting means to move along the second predetermined path, after the second identifying means (or judging means thereof) has identified that the cutting member has been displaced by the predetermined amount of distance from the operative position thereof. Thus, the cycle time necessary for forming stitches on the work cloth, cutting through the work cloth to form an opening, and cutting the needle thread, is shortened by an appreciable time duration. At the same time, the interference of the cutting member with the needle-thread cutting means is assuredly avoided. The above indicated predetermined amount of distance from the operative position of the cutting member may correspond to the shortest distance or shortest time, as measured from the operative position, that permits the needle-thread cutting means to start moving along the second predetermined path intersecting the first predetermined path, without causing the cutting member to interfere with the needle-thread cutting means.

In either the above indicated first or second embodiment, the detecting means may include a light-shading member having a multiplicity of slits formed at predetermined intervals of distance along the predetermined path, the light-shading member being attached to the cutting member, each of the slits permitting light to pass therethrough and having a first predetermined length along the predetermined path, each pair of adjacent two slits out of the multiplicity of slits defining a light-shading portion therebetween which shades light and therefore does not permit light to pass therethrough, the light-shading portion having a second predetermined length along the predetermined path, the detecting means further comprising light detecting means for emitting light toward the light-shading member and detecting the slits by receiving the light having passed through the slits and the light-shading portions alternate with the slits along the predetermined path by not receiving the light emitted toward the light-shading member, the generating means generating a first signal each time the light detecting means detects each of the slits, and generating a second signal different from the first signal each time the light detecting means detects each of the light-shading portions. In the first embodiment, the judging means may judge that the displacement of the cutting member has been stopped at the operative position, when the generating means does not generate the first signal for a first time duration predetermined for the each slit after the generating means has last generated the second signal, or when the generating means does not generate the second signal for a second time duration predetermined for the each light-shading portion after the generating means has last generated the first signal. In the second embodiment, the judging means may judge that the cutting member has been displaced by the predetermined amount of distance from the operative position, when the generating means has generated a predetermined number of the first signals after the cutting member has started to displace from the operative position.

Alternatively, in either the first or second embodiment, the detecting means may include a light-reflecting member having a multiplicity of slits formed at predetermined intervals of distance along the predetermined path, the light-reflecting member being attached to the cutting member, each of the slits permitting light to pass therethrough and having a first predetermined length along the predetermined path, each pair of adjacent two slits out of the multiplicity of slits defining a light-reflecting portion therebetween which reflects light, the light-reflecting portion having a second predetermined length along the predetermined path, the detecting means further comprising light detecting means for emitting light toward the light-reflecting member and detecting the slits by not receiving the light emitted toward the light-reflecting member and the light-reflecting portions alternate with the slits along the predetermined path by receiving the light reflected by the light-reflecting portions, the generating means generating a first signal each time the light detecting means detects each of the slits, and generating a second signal different from the first signal each time the light detecting means detects each of the light-reflecting portions. In the first embodiment, the may judge means judging that the displacement of the cutting member has been stopped at the operative position, when the generating means does not generate the first signal for a first time duration predetermined for the each slit after the generating means has last generated the second signal, or when the generating means does not generate the second signal for a second time duration predetermined for the each light-reflecting portion after the generating means has last generated the first signal. In the second embodiment, the judging means may judge that the cutting member has been displaced by the predetermined amount of distance from the operative position, when the generating means has generated a predetermined number of the first signals after the cutting member has started to displace from the operative position.

BRIEF DESCRIPTION OF THE DRAWINGS

The above and optional objects, features, and advantages of the present invention will be better understood by reading the following detailed description of the presently preferred embodiments of the invention when considered in conjunction with the accompanying drawings, in which:

FIG. 2 is a side view for explaining the retracted position of a work cloth cutting device of the sewing machine of FIG. 1;

DETAILED DESCRIPTION OF THE PREFERRED EMBODIMENTS

Figure 1:
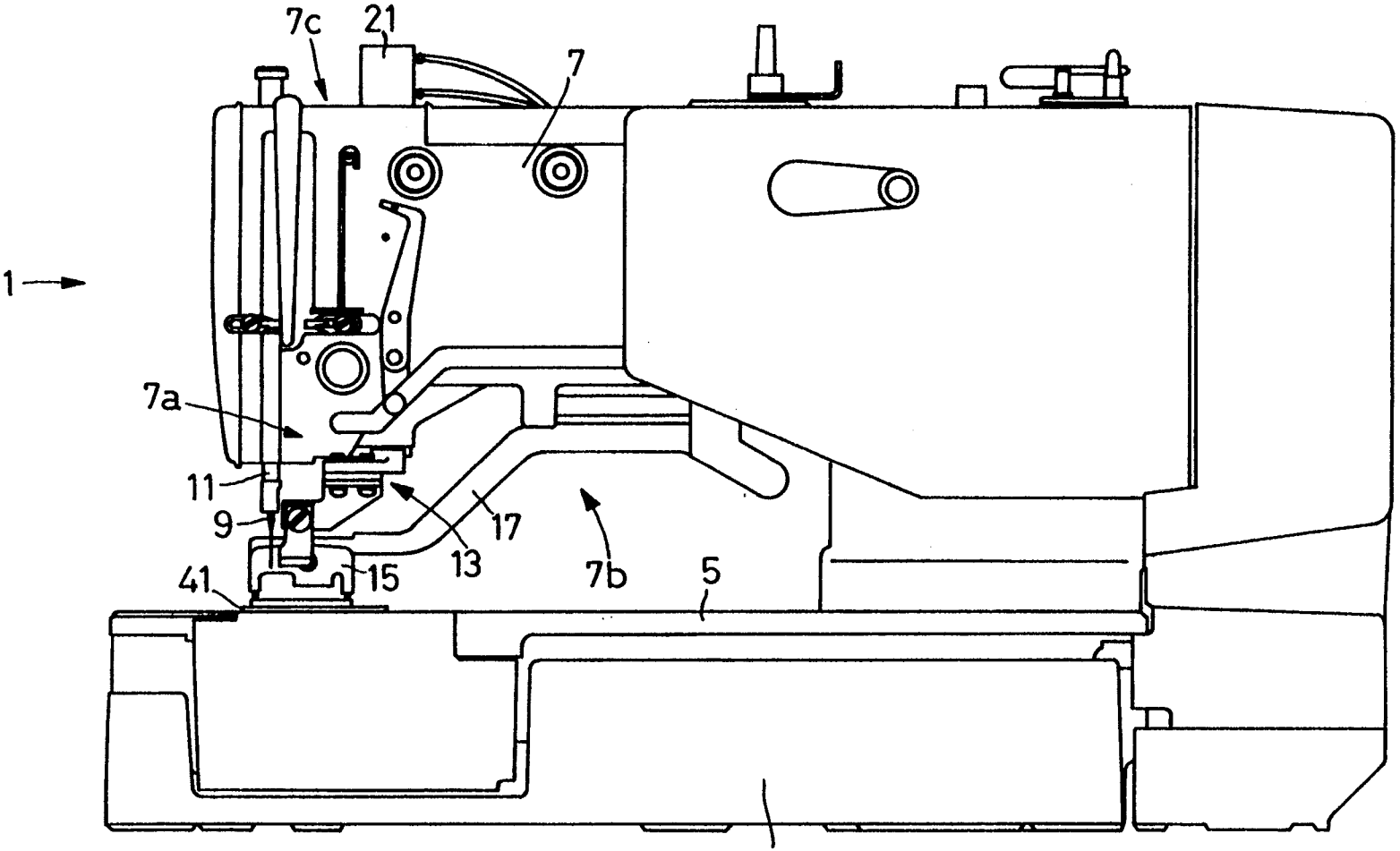
FIG. 1 is a side view of a buttonhole sewing machine to which the present invention is applied.

Referring first to FIG. 1, there is shown a buttonhole sewing machine 1 to which the present invention is applied. The sewing machine 1 is provided with a work sheet cutting apparatus embodying the present invention.

Figure 9:
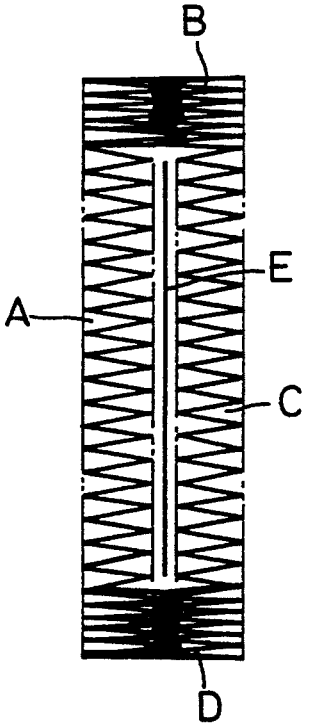
FIG. 9 is a plan view of a buttonhole sewing stitches formed on, and a button hole formed through, a work cloth by the sewing machine of FIG. 1.

As shown in FIG. 1, the sewing machine 1 includes a table 3, a bed 5 fixed to the table 3, and an arm 7 extending parallel to the upper surface of the bed 5. A free end portion 7*a* of the arm 7 supports a needle bar 11 to the lower end of which a sewing needle 9 is secured and which is interlocked with a main shaft (not shown) driven by a main motor 89 (FIG. 6) of the sewing machine 1 and effects a buttonhole sewing stitches, A, B, C, and D, as shown in FIG. 9 by laterally oscillating the needle 9 in synchronism with rotation of the main shaft. In the neighborhood of the needle bar 11, is disposed a work cloth cutting device 13 for cutting through the middle of a portion of a work sheet, such as a work cloth 40, on which portion the buttonhole sewing stitches A, B, C, D have been formed, and thereby providing an opening serving as a button hole, E, as shown in FIG. 9. An intermediate portion 7*b* of the arm 7 supports a work cloth feeding bar 17 to the free end of which a cloth presser 15 is secured. The feeding bar 17 is interlocked with the main shaft and is reciprocatable to advance and retract the cloth presser 15 and thereby feed the work cloth 40 pressed thereby on the bed 5.

Figure 3:
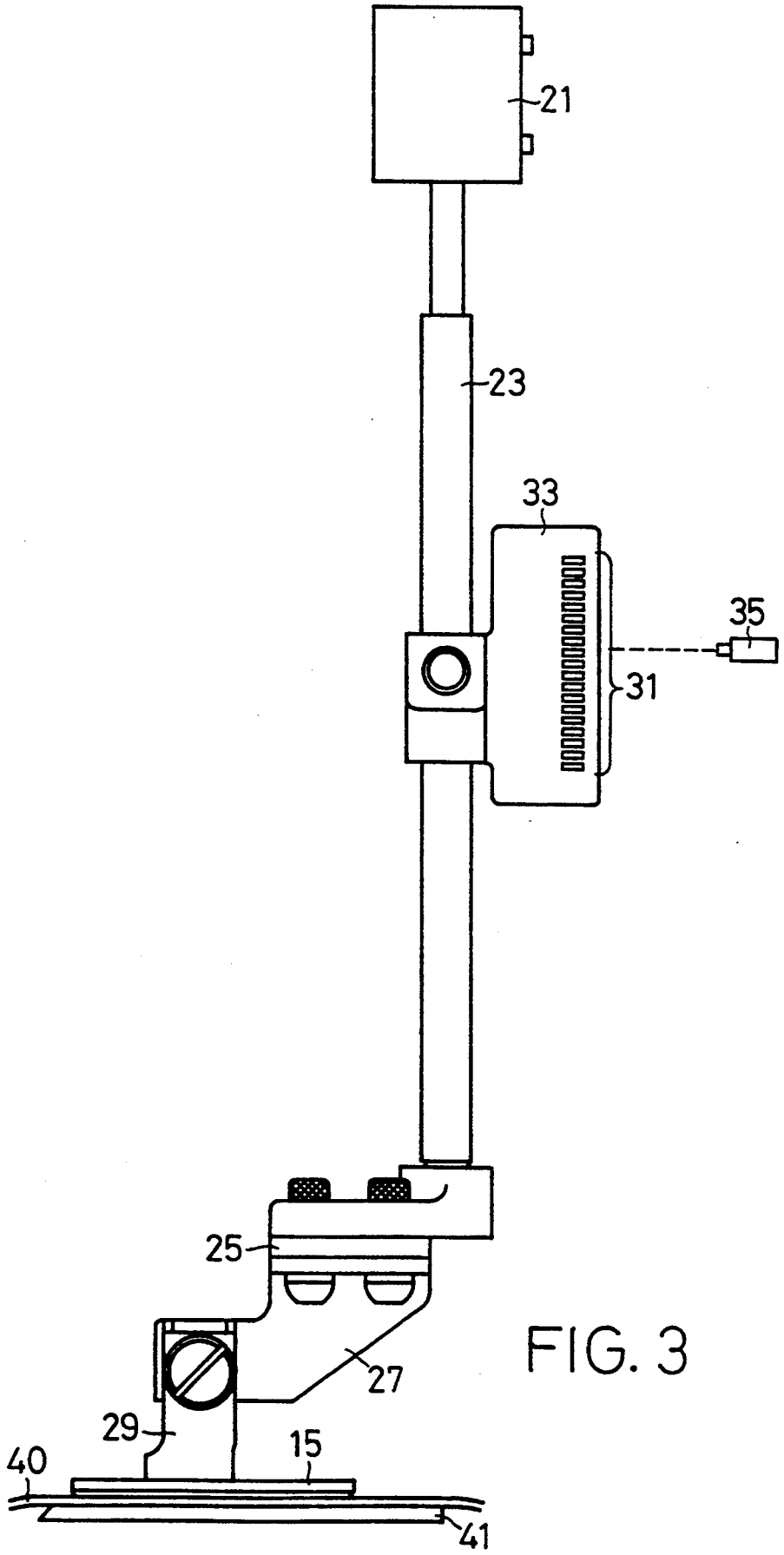
FIG. 3 is a side view for explaining the operative position of the work cloth cutting device of FIG. 2.

As shown in FIGS. 1, 2, and 3, the cutting device 13 includes an air cylinder 21 (hereinafter, referred to as "first cylinder" 21) disposed on an upper surface 7*c* of the arm 7, an actuator bar 23 the upper end of which is connected to the first cylinder 21, a mounting plate 25 fixed to the lower end of the actuator bar 23, a cutting-blade holder 27 fixed to the mounting plate 25, and a cutting blade 29 detachably secured to the holder 27.

To a generally middle portion of the actuator bar 23, is attached a light-shading plate 33 having a multiplicity of slits 31 formed through the thickness of the plate 33. The slits 31 are arranged in a vertical direction at predetermined intervals of distance (the interval is measured vertically from the center line of a slit to that of an adjacent slit). Each of the slits 31 extends in a horizontal direction, and has a predetermined length as measured vertically. Each slit 31 permits light to pass therethrough. Each pair of adjacent two slits out of the multiple slits 31 cooperate with each other to define a light-shading portion therebetween which extends horizontally and has a predetermined length as measured vertically, which length may be either the same as, or different from, that of each slit 31. Each of the light-shading portions alternate with the slits 31 shades light and therefore does not permit light to pass therethrough.

When the actuator bar 23 (or cutting blade 29) is displaced vertically upward and downward along a predetermined path by being driven by the first cylinder 21, the light-shading plate 33 is movable together with the bar 23 within a predetermined range of height or level. At a predetermined level within this level range of the light-shading plate 33, a light detector 35 is provided such that the light detector 33 is opposed to the slits 31 of the light-shading plate 33. The positional relationship between the light-shading plate 33 and the light detector 35 as shown in FIGS. 2 and 3 is offset by 90 degrees from the true or actual relationship in which a light emitting element and a light receiving element of the light detector 35 are positioned in front of, and in rear of, each of the planes of the sheets of FIGS. 2 and 3, respectively. The light detector 35 (or light receiving element thereof) generates a "DETECTION" signal when any one of the slits 31 is positioned at the same level as that of the light detector 35 and therefore that slit is detected by the detector 35. Similarly, the light detector 35 generates a "NON-DETECTION" signal when any one of the light-shading portions alternate with the slits 31 is positioned at the same level as that of the light detector 35 and therefore that light-shading portion is detected by the detector 35. Thus, the light detector 35 continuously generates alternate "DETECTION" signals and "NON-DETECTION" signals while the cutting blade 29 is displaced within a predetermined amount of distance from the operative position of the blade 29 which distance is included in a predetermined path along which the blade 29 is displaced between its operative and retracted positions by the first cylinder 21. The predetermined amount of distance contains the operative position of the blade 29.

FIG. 2 shows the work cloth cutting device 13 or cutting blade 29 is located at the retracted position thereof away from a support member 41 which is secured on the upper surface of the bed 5 and on which the work cloth 40 is retained under the cloth presser 15. In this condition, the first cylinder 21 is driven to displace vertically downward the actuator bar 23 until the cutting blade 29 reaches an operative position thereof as shown in FIG. 3 at which the blade 29 is received by the support 41 so that the blade 29 cuts through the cloth 40 and thereby provides a button hole (FIG. 9) in the cloth 40.

Figure 4A:
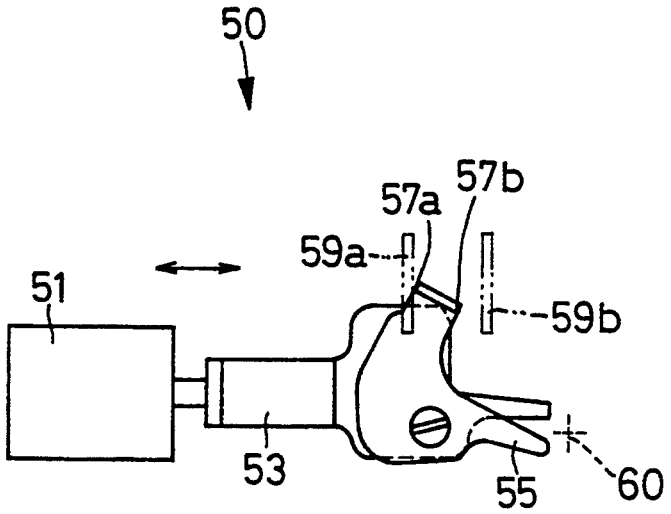
FIGS. 4A and 4B are a plan and a side view for explaining the retracted position of a needle thread cutting device of the sewing machine of FIG. 1.
Figure 4B:
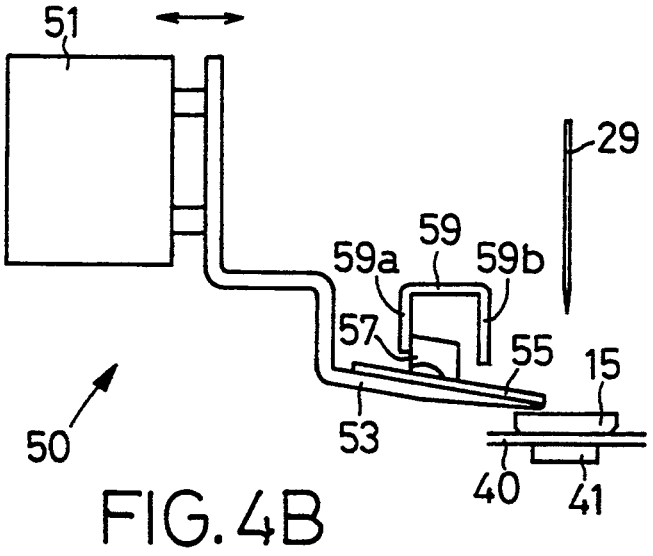
Figure 5A:
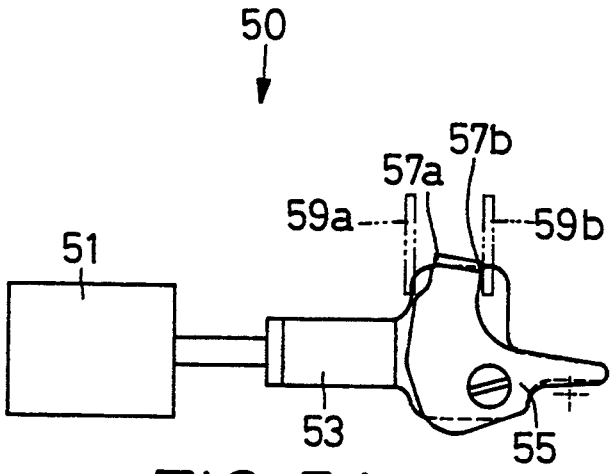
FIGS. 5A and 5B are a plan and a side view for explaining the operative position of the needle thread cutting device of FIGS. 4A and 4B.
Figure 5B:
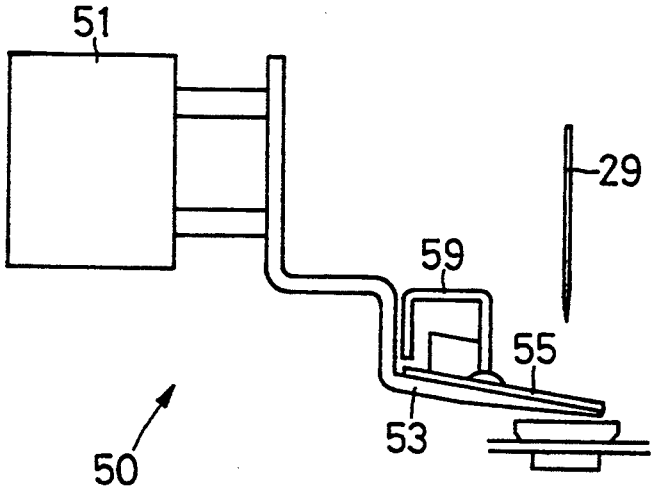

The sewing machine 1 further includes a needle-thread cutting device 50 as shown in FIGS. 4A, 4B, 5A, and 5B which is disposed in the neighborhood of the work cloth cutting (or buttonhole opening) device 13. FIGS. 4A and 5A are plan views of the needle-thread cutting device 50, whereas FIGS. 4B and 5B are left-hand side views of the same 50 (as seen from the left-hand side in FIG. 1).

The needle-thread cutting device 50 includes an air cylinder 51 (hereinafter, referred to as the "second cylinder" 51), a lower scissor 53 which is fixed to the second cylinder 51 and is movable in a direction indicated at arrow in FIGS. 4A and 4B by being actuated by the second cylinder 51, an upper scissor 55 which is pivotally mounted on the upper surface of the lower scissor 53, and an actuator plate 59 which defines a permission range within which an upright portion 57 of the upper scissor 55 is permitted to move relative to the lower scissor 53. The actuator 59 is fixed to the free end portion *7a* of the arm 7.

The needle-thread cutting device 50 is operated for cutting a needle thread 60 conveyed by the sewing needle 9, after the buttonhole sewing operation has completed on the work cloth 40 and the work-cloth cutting device 13 has cut open the cloth 40. FIGS. 4A and 4B shows a retracted position of the cutting device 50 where the second cylinder is not being driven for moving the pair of scissors 53, 55 to cut the needle thread 60. In this condition, a rear end 57*a* of the upright portion 57 is in contact with a rear portion 59*a* of the actuator plate 59, and the upper scissor 55 has been pivoted relative to the lower scissor 53 in a direction in which to open the pair of scissors 53, 55. If the second cylinder 51 is driven and extended, the pair of scissors 53, 55 are moved toward the needle thread 60 with the upper one 55 being open relative to the lower one 53, so that the two scissors 53, 55 captures the needle thread 60 in a space currently defined therebetween. Subsequently, the second cylinder 51 is further extended so that, as shown in FIGS. 5A. and 5B, a front end 57*b* of the upright portion 57 comes into contact with a front portion 59*b* of the actuator plate 59 and the upper scissor 55 is pivoted relative to the lower scissor 53 in a direction in which to close the pair of scissors 53, 55. Thus, the needle thread 60 is cut off.

Figure 6:
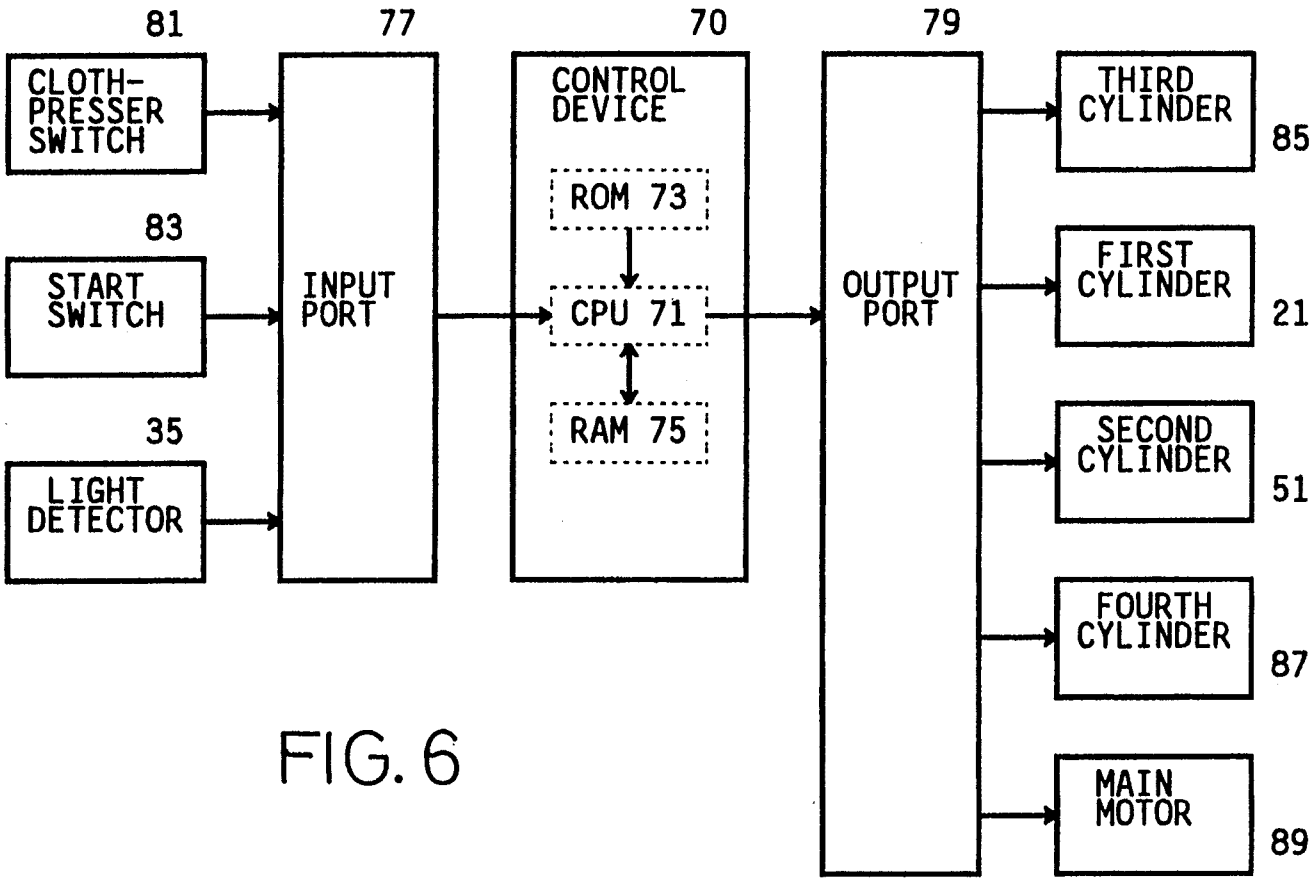
FIG. 6 is a block diagram of a control circuit of the sewing machine of FIG. 1.

The operation of the buttonhole sewing machine 1 including the work cloth cutting device 13 and the needle thread cutting device 50, is controlled by a control device 70 shown in FIG. 6. The control device 70 is a so-called microcomputer including a central processing unit (CPU) 71, a read only memory (ROM) 73, a random access memory 75, an input port 77, and an output port 79. A cloth-presser switch 81, a start switch 83, and the light detector 35 are connected to the input port 77. The output port 79 is connected to the first cylinder 21, the second cylinder 51, a third cylinder 85 for actuating the work cloth feeding bar 17 (and therefore the cloth presser 15) and thereby retaining the work cloth 40 on the bed 5 (or support 41), a fourth cylinder 87 for cutting a bobbin thread which is locked with the needle thread to form stitches on the work cloth 40, and the main motor 89 for rotating the main shaft (not shown) of the sewing machine 1.

Figure 7:
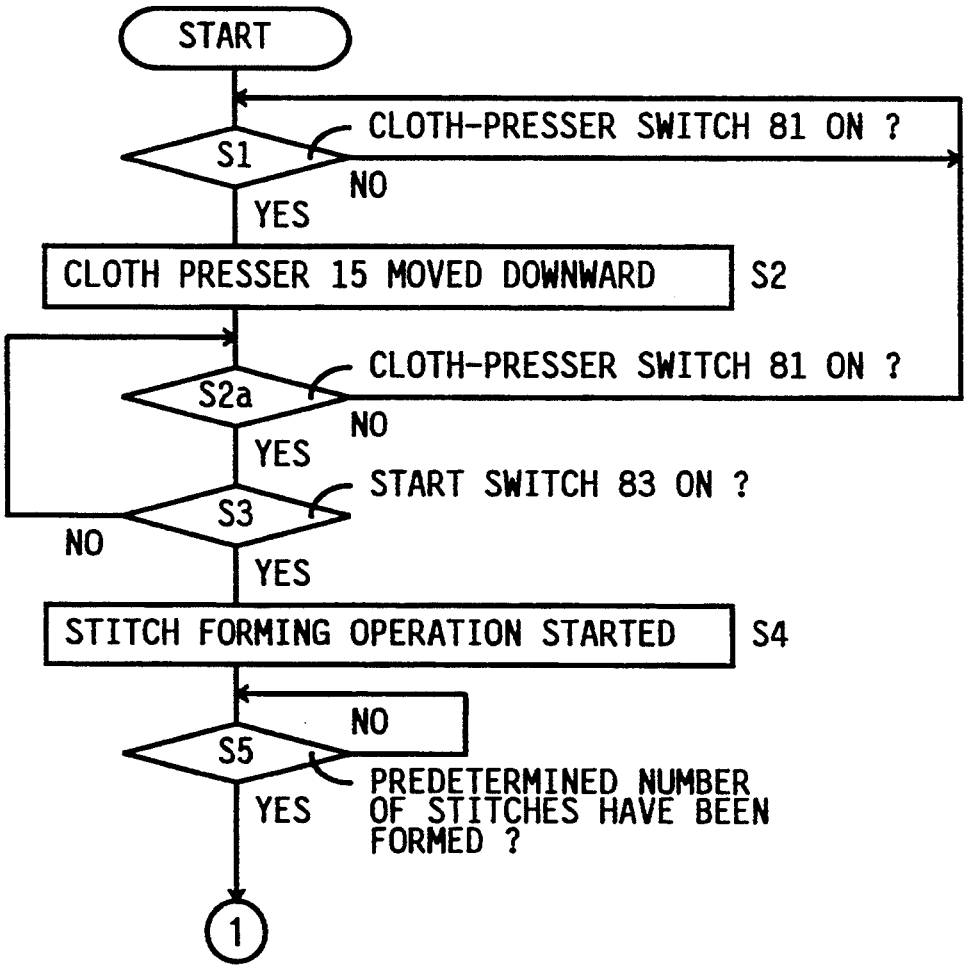
FIG. 7 is a flow chart representing the first half of the operation of the sewing machine of FIG. 1.
Figure 8:
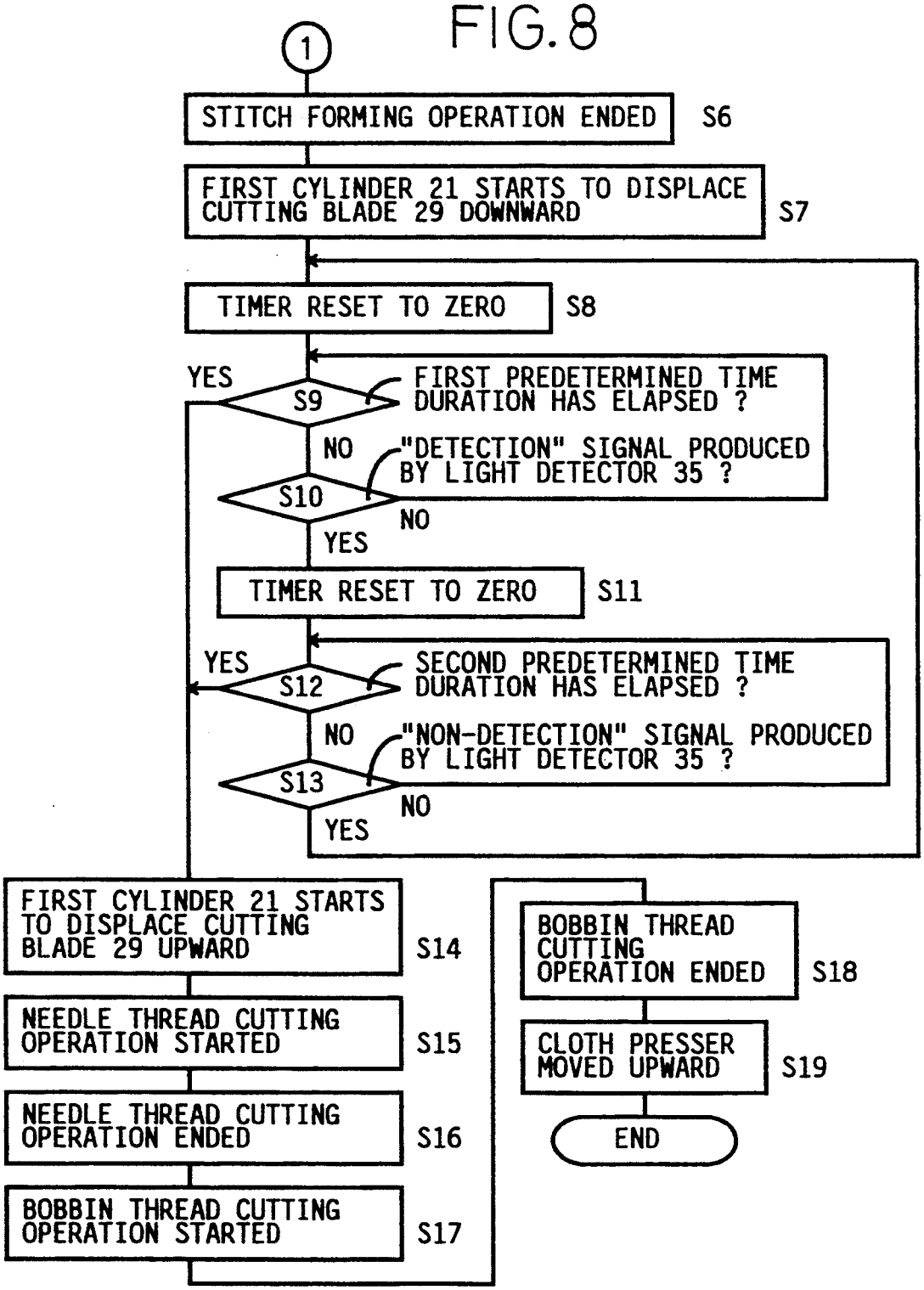
FIG. 8 is a flow chart representing the second half of the operation of the sewing machine of FIG. 1.

The sewing machine 1 constructed as described above is operated according to the flow charts shown in FIGS. 7 and 8. The sewing machine sequentially carries out the buttonhole sewing operation, the buttonhole opening operation, the needle thread cutting operation, and the bobbin thread cutting operation in the order of description. Before operating the start switch 83 of the sewing machine 1, an operator places a work cloth 40 in position on the bed 5, and operates the cloth-presser switch 81 to press the work cloth 40 on the bed 40 with the cloth presser 15. The control device 70 controls the above indicated various operations by utilizing the temporary-storage function of the RAM 75 according to the control programs stored in the ROM 73 which programs are represented by the flow charts of FIGS. 7 and 8.

The control of the CPU 71 of the control device 70 begins with Step S1 to wait for the cloth-presser switch 81 to be operated "ON". If an affirmative result (YES) is obtained in Step S1, the control of the CPU 71 proceeds with Step S2 to operate the third cylinder 85 so that the cloth presser 15 presses the work cloth 40 on the support 41. Step S2 is followed by Step S2*a* to judge whether the cloth-presser switch 81 is "ON". If a negative judgement (NO) is made in Step S2*a*, the control goes back to Step S1. On the other hand, if an affirmative result is obtained in Step S2*a*, the control proceeds with Step S3 to judge whether the start switch 83 has been operated "ON". If a negative judgement (NO) is made in Step S3, the control goes back to Step S2*a*. On the other hand, if an affirmative result is obtained in Step S3, the control proceeds with Step S4 to operate or rotate the main motor 89. Step S4 is followed by Step S5 to judge whether the sewing machine 1 or sewing needle 9 has formed a predetermined number of stitches. If an affirmative result is obtained in Step S5, the control goes to Step S6 to stop the operation or rotation of the main motor 89.

Thus, as conventionally known in the art, the needle bar 11 is vertically oscillated, a device (not shown) is operated for laterally oscillating the needle bar 11, a shuttle (not shown) is driven, and the work cloth feeding bar 17 is actuated for feeding the work cloth 40, so that a complete buttonhole sewing stitches are formed on the work cloth 40 in the order of respective portions A, B, C, D shown in FIG. 9.

Step S6 is followed by Step S7 in which the CPU 71 of the control device 70 generates an "ADVANCE" signal to the first cylinder 21 so as to displace downward the cutting blade 29. Step S7 is followed by Step S8. In this step, the CPU 71 resets a timer to zero, when the CPU 71 receives the first "DETECTION" signal and the next "NON-DETECTION" signal from the light detector 35. Thus, the CPU 71 verifies that the cutting blade 29 starts to displace downward from its retracted position (or original position). In the following Step S9, it is judged whether the time measured by the timer has exceeded a first predetermined time duration. If a negative judgement is made in Step S9, the control of the CPU 71 goes to Step S10 to judge whether the CPU 71 has received another "DETECTION" signal from the light detector 35, that is, whether the "NON-DETECTION" signal received in Step S8 is changed to a "DETECTION" signal. If an affirmative judgement is made in Step S10, the control goes to Step S11 to reset the timer to zero. Step S11 is followed by Step S12 to identify whether the time measured by the timer has exceeded a second predetermined time duration. If a negative judgement is made in Step S12, the control of the CPU 71 goes to Step S13 to judge whether the CPU 7 has received another "NON-DETECTION" signal, that is, whether the "DETECTION" signal received in Step S10 is changed to a "NON-DETECTION" signal. If an affirmative judgement is made in Step S13, the control goes back to Step S8 to reset the timer to zero, and further to Step S9 and the following steps. On the other hand, if an affirmative judgement is made in Step S9 or in Step S12, that is, if the CPU 71 has not received another "DETECTION" signal for the first time duration, or another "NON-DETECTION" signal for the second time duration, the CPU 71 judges that the downward displacement of the cutting blade 29 has been stopped at the operative position on the support 41. Immediately, the control of the CPU 71 goes to Step S14 to generate a "RETRACT" signal to the first cylinder 21 to start displacing upward the cutting blade 29.

Thus, the cutting blade 29 cuts through the middle line E between the buttonhole sewing stitches A, C, and is received by the support 41. In this way, the formation of an opening serving as a button hole is completed. The CPU 71 determines the time when the cutting blade 29 is received by the support 41, by recognizing that the CPU 71 does not receive a "DETECTION" signal from the light detector 35 for the first predetermined time duration after having received the last "NON-DETECTION" signal, or a "NON-DETECTION" signal for the second predetermined time duration after having received the last "DETECTION" signal. Upon the determination of the time of reception of the cutting blade 29 by the support 41, the CPU 71 immediately causes the cutting blade 29 to start displacing upward toward its retracted position.

After the opening of a button hole is finished, that is, after Step S14, the control of the CPU 71 goes to Step S15 to generate an "ADVANCE" signal to the second cylinder 51 so as to advance the pair of scissors 53, 55 and cut the needle thread 60. Step S15 is followed by Step S16 to supply a "RETRACT" signal to the second cylinder 51 so as to retract the pair of scissors 53, 55. Further, in Step S17, the fourth cylinder 87 is actuated to advance a bobbin thread cutting device (not shown) and cut the bobbin thread and, in Step S18, the fourth cylinder 87 is operated to retract the bobbin thread cutting device to its retracted position. Finally, in Step S19, the third cylinder 85 is operated to move upward the cloth presser 15 and thereby release the work cloth 40 on which the buttonhole sewing stitches and the buttonhole have been formed.

In this way, the buttonhole sewing machine 1 automatically and sequentially carries out the above described various operations, that is, buttonhole sewing operation, button hole cutting operation, needle thread cutting operation, and bobbin thread cutting operation. In the buttonhole cutting operation, the control device 70 does not stop the downward displacement of the cutting blade 29 so long as the CPU 71 continues to recognize a change of the "DETECTION" and "NON-DETECTION" signals from the light detector 35 in a predetermined time duration after the last change of those signals. Thus, the sewing machine 1 is capable of cutting a buttonhole through a work cloth with high reliability. Even in the event that the cutting blade 29 is sharpened or ground and consequently is shorted, it is not necessary to adjust the positions of the light-shading member 33 or the light detector 35.

In the illustrated sewing machine 1, the cutting blade 29 is displaced upward immediately after the CPU 71 identifies that the downward displacement of the cutting blade 29 has been stopped at the operative position, that is, if the CPU 71 does not recognize a change of a "DETECTION" signal to a "NON-DETECTION" signal, or vice versa, in a predetermined time duration after the last change. Therefore, the sewing machine 1 is free of the problem that the cutting blade 29 is pressed against the receiver 41 with an excessively large force by the first cylinder 21, or other problems such as excessive wear and breakage of the blade 29.

Next, there will be described another embodiment of the present invention. The present, second embodiment is readable on the buttonhole sewing machine 1 shown in FIGS. 1–6. However, in the present embodiment, the sewing machine 1 is operated according the control program represented by the flow chart of FIG. 10 in place of the flow chart of FIG. 8. The control program represented by the flow chart of FIG. 7 is utilized in the present embodiment, too. The differences between the flow charts of FIG. 8 and FIG. 10 will be described below.

Figure 10:
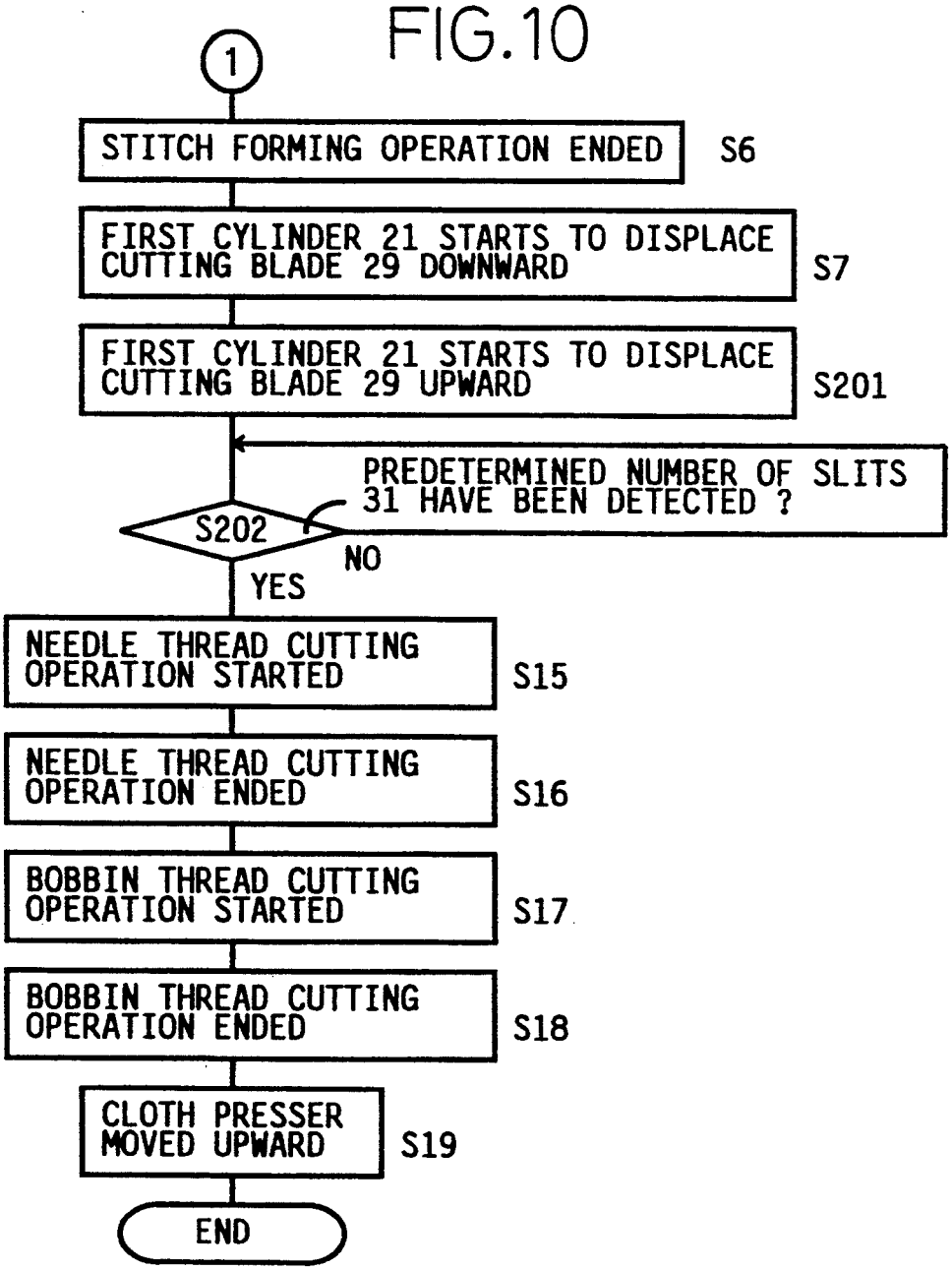
FIG. 10 is a flow chart corresponding to FIG. 8, for representing the second half of the operation of a different buttonhole sewing machine to which the present invention is applied.
Figure 11:
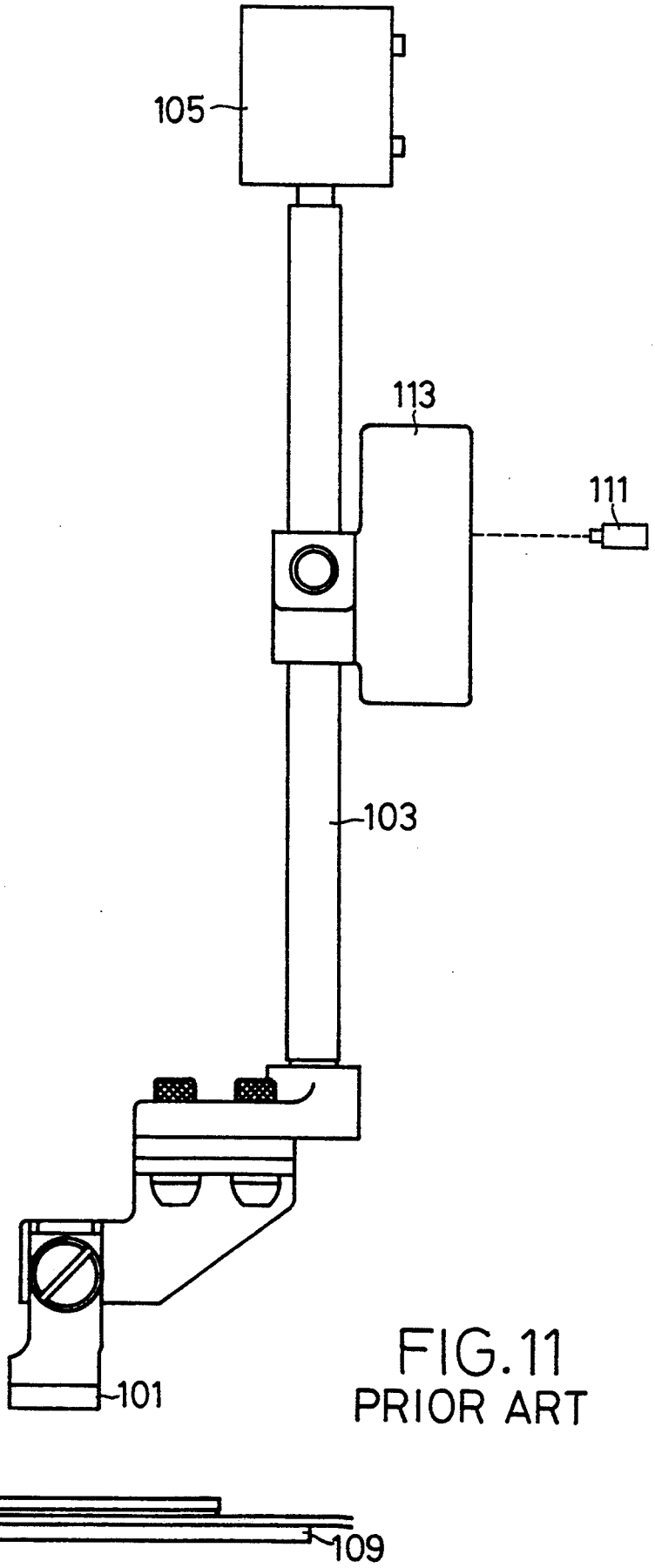
FIG. 11 PRIOR ART
FIG. 11 is a side view for explaining the retracted position of a work cloth cutting device of a known buttonhole sewing machine.
Figure 12:
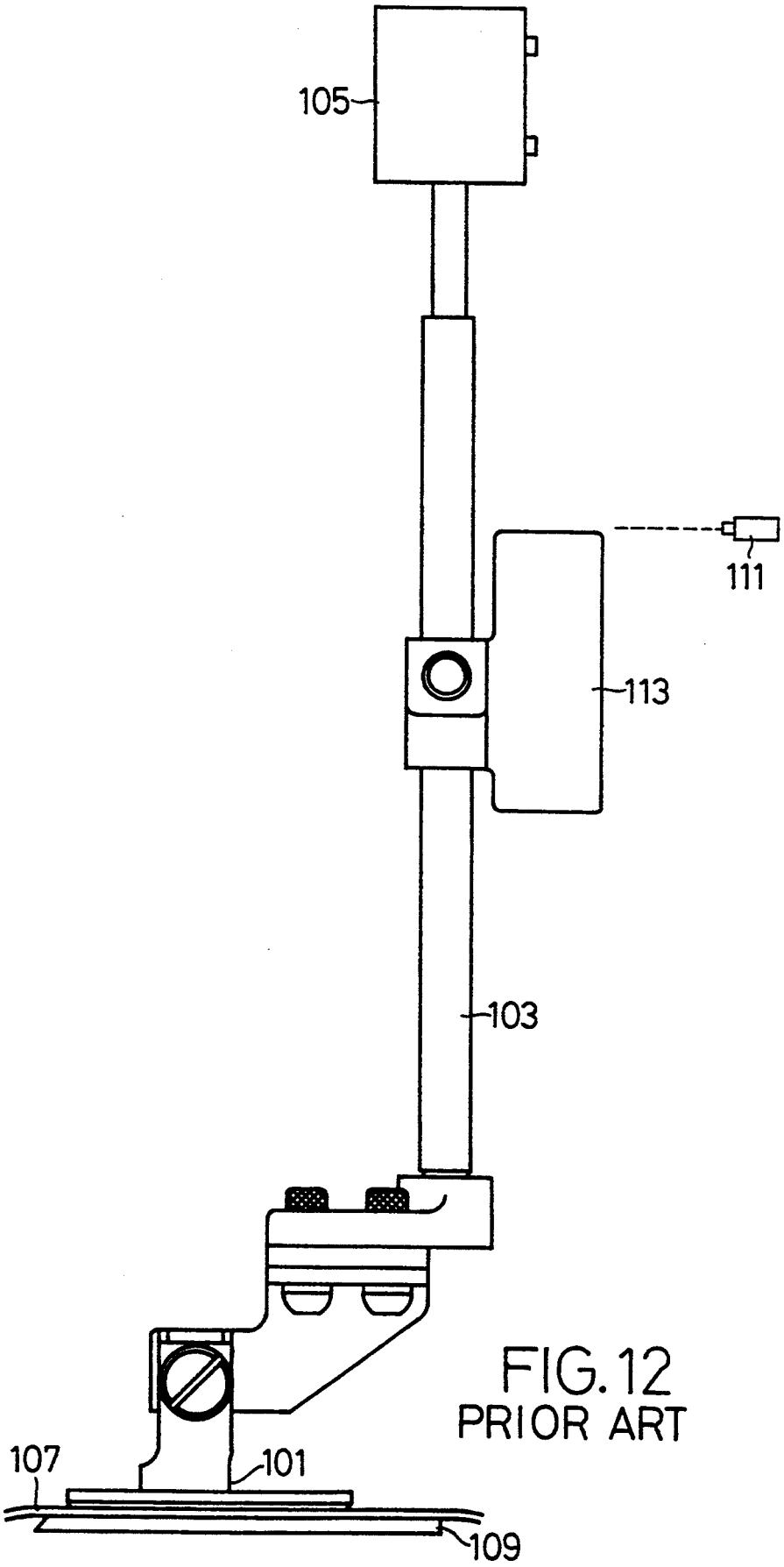
FIG. 12 PRIOR ART
FIG. 12 is a side view for explaining the operative position of the work cloth cutting device of FIG. 11.
Figure 13:
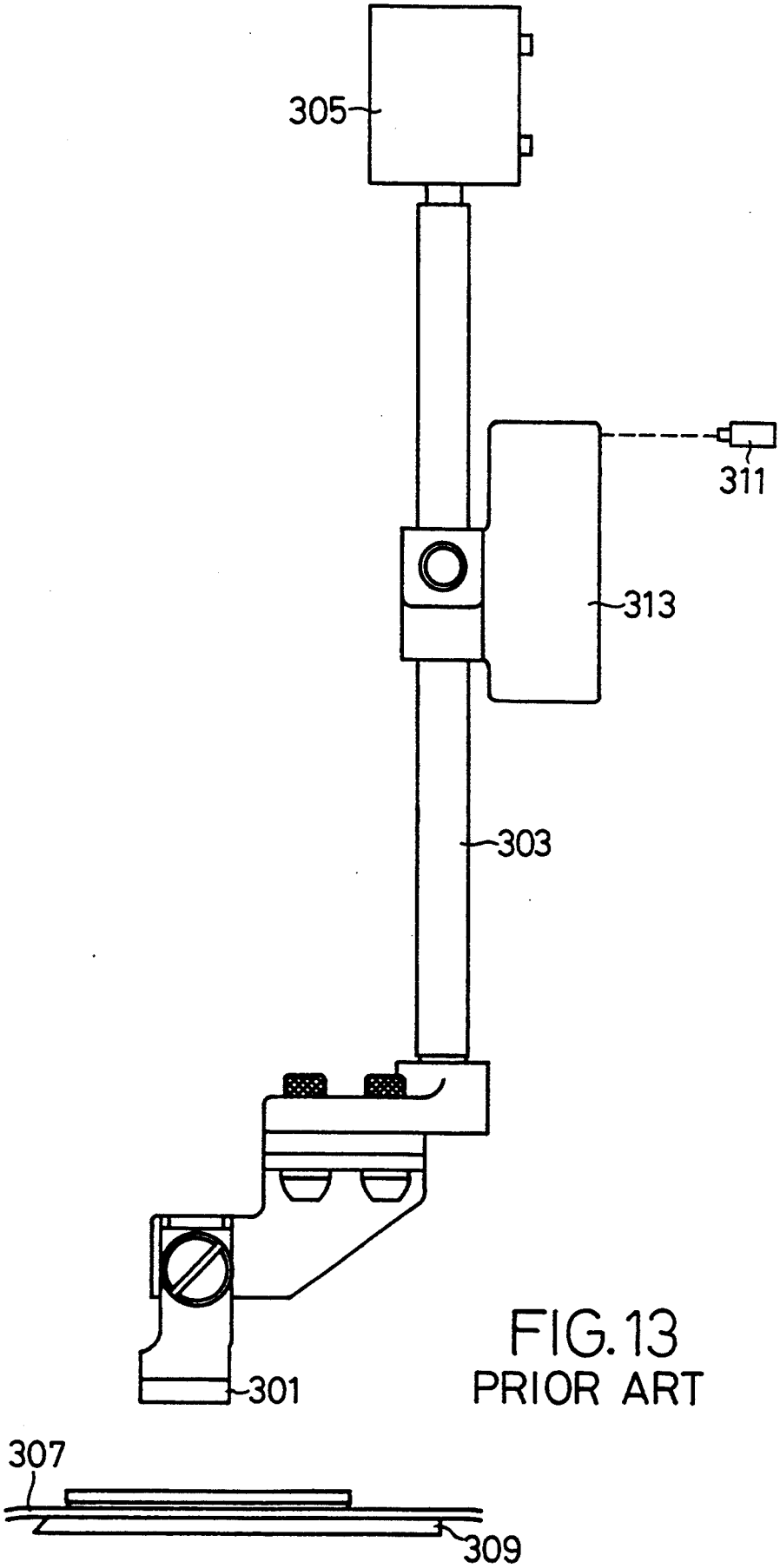
FIG. 13 PRIOR ART
FIG. 13 is a side view for explaining the retracted position of a work cloth cutting device of a different known buttonhole sewing machine.
Figure 14:
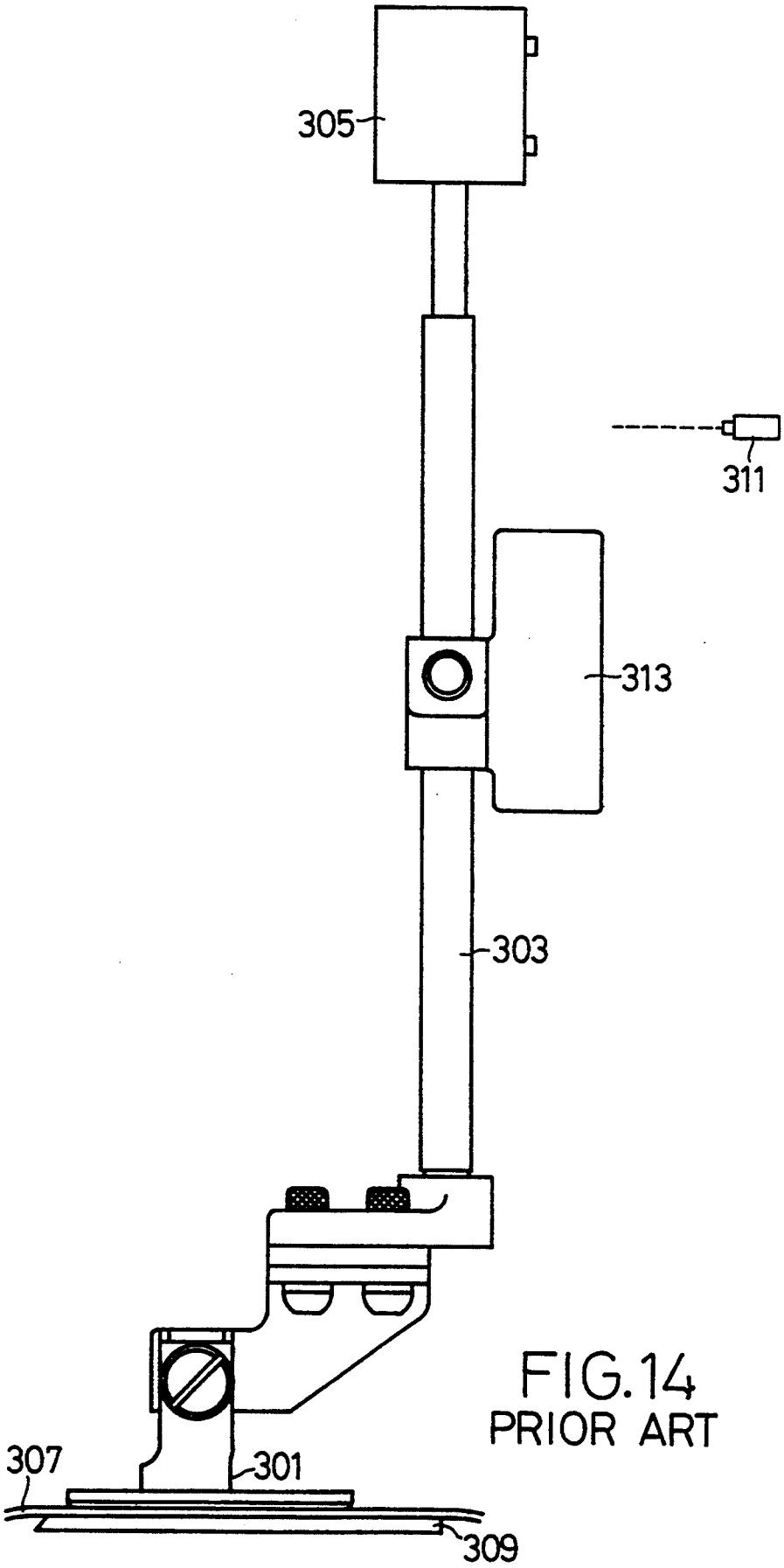
FIG. 14 PRIOR ART
FIG. 14 is a side view for explaining the operative position of the work cloth cutting device of FIG. 13.

The flow chart of FIG. 10 does not contain Steps S8 to S13 of FIG. 8, replaces Step S14 of FIG. 8 with Step S201, and newly add Step S202. In the present embodiment, Steps S1–S7 and S15–S19 are effected in the same ways as those in the preceding, first embodiment.

In the present embodiment, after the CPU 71 generates an "ADVANCE" signal to the first cylinder 21 in Step 7, the control of the CPU 71 goes to Step S201 in which the CPU 71 generates a "RETRACT" signal to the first cylinder 21 when the cutting blade 29 has been displaced downward by a predetermined length or stroke. Thus, the cutting blade 29 cuts through the work cloth 40, and is received by the support 41. As a result, the buttonhole E shown in FIG. 9 is formed in the work cloth 40.

After the buttonhole cutting operation has been completed and the cutting blade 29 has started displacing upward from the operative position on the support 41, the control of the CPU 71 goes to Step S202 to judge whether the CPU 71 has received a predetermined number of "DETECTION" signals from the light detector 35, that is, whether the CPU 1 has recognized a predetermined number of "NON-DETECTION" to "DETECTION" signal changes from the light detector 35. If an affirmative judgement is made in Step S202, it means that the cutting blade 29 has been displaced by a predetermined amount of distance from the operative position where the blade 29 is received by the support 41. In this event, the control of the CPU 71 immediately proceeds with Step S15 to generate an "ADVANCE" signal to the second cylinder 51 to advance the pair of scissors 53, 55 so as to cut the needle thread 60. The above indicated predetermined number of signal changes of the light detector 35 corresponds to the above indicated predetermined amount of distance from the operative position of the cutting blade 29. This amount of distance is so predetermined as to permit the needle-thread cutting device 50 to move along its predetermined path without being interfered by the work cloth cutting device 13, in particular, cutting blade 29 or actuator bar 23.

In the present embodiment, the needle-thread cutting device 50 starts to operate for cutting the needle thread 60, immediately after the work cloth cutting device 13 has been displaced by the predetermined amount of distance to a "non-interference" position where the latter device 13 cannot interfere with the former device 50. Therefore, the whole cycle time necessary to produce a finished work cloth having a button hole and a buttonhole sewing stitches, is largely shortened.

In the present embodiment, the amount of displacement of the cutting blade 29 from the operative position is measured by counting the number of "NON-DETECTION" to "DETECTION" signal changes from the light detector 35, and the measured amount of displacement is utilized for identifying that the blade 29 has been displaced by the predetermined amount of distance from the operative position, in contrast to the conventional manner in which it is identified that a cutting blade has been retracted to a "non-interference" position where the blade cannot interfere with one or more other devices operable for working a work cloth. Therefore, even in the event that the cutting blade 29 is sharpened or ground and consequently is shortened, it is possible to use the control programs represented by the flow charts of FIGS. 7 and 10, without needing any modification thereof, and prevent the needle-thread cutting device 50 with high reliability from being interfered by the work-cloth cutting device 13.

Next, there will be described the third embodiment of the present invention. The difference between the third embodiment and the previously described first embodiment, is that Step S202 of FIG. 10 for the second embodiment is carried out between Step S14 and S15 of FIG. 8 for the first embodiment. The other Steps S1–S14 and S15–S19 for the first embodiment are carried out in the same ways also in the instant, third embodiment.

In the third embodiment, the buttonhole sewing machine 1 enjoys the advantages provided by both the first and second embodiments. For example, the sewing machine 1 reliably identifies that the cutting blade 29 has been stopped on the support 41, and additionally accurately determines the time when the cutting blade 29 has been displaced by a predetermined amount of distance from the operative position thereof where the blade 29 is received by the support 41.

While the present invention has been described in detail in the preferred embodiments, it is to be understood that the present invention is by no means limited to the particulars of the illustrated embodiments.

For example, it is possible to continuously calculate, based on the alternate "DETECTION" and "NON-DETECTION" signals from the light detector 35, a rate or speed of the downward displacement of the cutting blade 29 when the cutting blade 29 is displaced within an intermediate range included in its predetermined path between the operative position where the blade 29 is received by the support 41 and its retracted position spaced away from the operative position. In this case, the control device 71 may be adapted to control, if the measured displacement speed of the blade 29 becomes higher than a reference value, the first cylinder 21 so as to reduce the speed of the blade 29. Thus, the sewing machine 1 is capable of preventing the blade 29 from impacting the support 41 with excessively high speed or high pressing force, which may result in excessive wear or even breakage of the blade 29.

While the light detector 35 used in the illustrated embodiments are of the transmission type in which the light transmitted through the slits 31 is detected by the light receiving element of the light detector 35, it is possible to alternatively use a light detector of the reflection type in which a light receiving element is used for detecting the light emitted from a light emitting element and reflected from light-reflecting portions provided alternately with slits 31 on a light-reflecting member used in place of the light-shading member 33.

In addition, the light-shading plate 33 having the slits 31, used in the illustrated embodiment, may be replaced with an actuator bar 23 on the side surface of which alternate white and black stripes are drawn. In this case, the light detector 35 is adapted to detect changes in the intensity of the light reflected from the white and black stripes. Alternatively, it is possible to use an actuator bar 23 on the side surface of which the stripes formed of alternate magnetic and non-magnetic materials are provided. In the latter case, a magnetism pick-up device is used for detecting those stripes.

Furthermore, the equidistant slits 31 formed in the light-reflecting plate 33, used in the illustrated embodiments, may be replaced with non-equidistant slits. In this case, with respect to the above described second embodiment, it is necessary to store data representing the history of the downward movement of the cutting blade 29 and modify the control program of FIG. 10, in particular, Step S202 to calculate, based on the stored history, a current amount of upward displacement of the blade 29 from its operative position. Even in this case the sewing machine 1 provides the same advantages as those described with respect to the second embodiment.

While the illustrated embodiments relates to a buttonhole sewing machine, the principle of the present invention may be applicable to various machines which are equipped with a work sheet cutting apparatus.

It is to be understood that the present invention may be embodied with other changes, improvements, and modifications that may occur to those skilled in the art without departing from the scope and spirit of the invention defined in the appended claims.

What is claimed is:

1. A work sheet cutting apparatus for cutting a work sheet, comprising:

a cutting member for cutting said work sheet;

a support member on which said work sheet is to be received when said cutting member is cutting through said work sheet;

actuating means for displacing said cutting member in a reciprocating movement relative to said support member along a predetermined path producing a sheet-cutting stroke between an operative and a retracted position of said cutting member, said sheet-cutting stroke continuously displacing the cutting member from said retracted position until the cutting member is received and stopped by the support member at said operative position;

detecting means for continuously detecting the displacement of said cutting member within a predetermined range included in said predetermined path and including said operative position of the cutting member, and generating continuous signals which change with said displacement of the cutting member and represent that said cutting member is displacing within said predetermined range; and first identifying means for identifying that said displacement of said cutting member has been stopped at said operative position of the cutting member, when said continuous signals do not change for a predetermined time duration.

2. A work sheet cutting apparatus according to claim 1, wherein said predetermined range including said operative position of said cutting member is divided into a multiplicity of divided portions which are contiguous with each other, said detecting means comprising generating means for generating said continuous signals, said generating means generating, each time said cutting member enters each of said divided portions of said predetermined range while displacing toward said operative position along said predetermined path, a corresponding one of said continuous signals, said first identifying means identifying that said displacement of said cutting member has been stopped at said operative position, when said generating means does not generate said corresponding one signal for said each divided portion for a time duration predetermined for said each divided portion after said generating means has generated the signal for a backward adjacent divided portion out of said contiguous divided portions.

3. A work sheet cutting apparatus according to claim 2, wherein said detecting means includes a light-shading member having a multiplicity of slits formed at predetermined intervals of distance along said predetermined path, said light-shading member being attached to said cutting member, each of said slits permitting light to pass therethrough and having a first predetermined length along said predetermined path, each pair of adjacent two slits out of said multiplicity of slits defining a light-shading portion therebetween which shades light and therefore does not permit light to pass therethrough, said light-shading portion having a second predetermined length along said predetermined path, said detecting means further comprising light detecting means for emitting light toward said light-shading member and detecting said slits by receiving the light having passed through said slits and the light-shading portions alternate with said slits along said predetermined path by not receiving the light emitted toward the light-shading member, said generating means generating a first signal each time said light detecting means detects each of said slits, and generating a second signal different from said first signal each time said light detecting means detects each of said light-shading portions, said identifying means identifying that said displacement of said cutting member has been stopped at said operative position, when said generating means does not generate said first signal for a first time duration predetermined for said each slit after said generating means has last generated said second signal, or when said generating means does not generate said second signal for a second time duration predetermined for said each light-shading portion after said generating means has last generated said first signal.

4. A work sheet cutting apparatus according to claim 2, wherein said detecting means includes a light-reflecting member having a multiplicity of slits formed at predetermined intervals of distance along said predetermined path, said light-reflecting member being attached to said cutting member, each of said slits permitting light to pass therethrough and having a first predetermined length along said predetermined path, each pair of adjacent two slits out of said multiplicity of slits defining a light-reflecting portion therebetween which reflects light, said light-reflecting portion having a second predetermined length along said predetermined path, said detecting means further comprising light detecting means for emitting light toward said light-reflecting member and detecting said slits by not receiving the light emitted toward the light-reflecting member and the light-reflecting portions alternate with said slits along said predetermined path by receiving the light reflected by said light-reflecting portions, said generating means generating a first signal each time said light detecting means detects each of said slits, and generating a second signal different from said first signal each time said light detecting means detects each of said light-reflecting portions, said identifying means identifying that said displacement of said cutting member has been stopped at said operative position, when said generating means does not generate said first signal for a first time duration predetermined for said each slit after said generating means has last generated said second signal, or when said generating means does not generate said second signal for a second time duration predetermined for said each light-reflecting portion after said generating means has last generated said first signal.

5. A work sheet cutting apparatus according to claim 1, further comprising second identifying means for identifying, based on the generated continuous signals, whether said cutting member has been displaced by a predetermined distance from said operative position.

6. The work sheet cutting apparatus according to claim 1, wherein said detecting means generates continuous electric signals representing that said cutting member is displacing within said predetermined range.

7. A work sheet cutting apparatus for cutting a work sheet, comprising:

a cutting member for cutting said work sheet;

a support member on which said work sheet is to be received when said cutting member is cutting through said work sheet;

actuating means for displacing said cutting member in a reciprocating movement relative to said support member along a predetermined path producing a sheet-cutting stroke between an operative and a retracted position of said cutting member, said sheet-cutting stroke continuously displacing the cutting member from said retracted position until the cutting member is received and stopped by the support member at said operative position;

detecting means for continuously detecting the displacement of said cutting member within a predetermined range included in said predetermined path and including said operative position of the cutting member, and generating continuous signals which change with said displacement of the cutting member and represent an amount of displacement of said cutting member within said predetermined range; and identifying means for identifying, based on an amount of change of said continuous signals from an initial displacement of said cutting member at said operative position toward said retracted position, whether said cutting member has been displaced by a predetermined distance from said operative position of the cutting member.

8. A work sheet cutting apparatus according to claim 7, wherein said predetermined range including said operative position of said cutting member is divided into a multiplicity of divided portions which are contiguous with each other, said detecting means comprising generating means for generating said continuous signals, said generating means generating, each time said cutting member enters each of said divided portions of said predetermined range while displacing from said operative position along said predetermined path, a corresponding one of said continuous signals, said identifying means identifying that said cutting member has been displaced by said predetermined amount of distance from said operative position, when said generating means, when said generating means has generated a predetermined number of said continuous signals after said cutting member has started to displace from said operative position.

9. A work sheet cutting apparatus according to claim 8, wherein said cutting member includes a light-shading member having a multiplicity of slits formed at predetermined intervals of distance along said predetermined path, each of said slits permitting light to pass therethrough and having a first predetermined length along said predetermined path, each pair of adjacent two slits out of said multiplicity of slits defining a light-shading portion therebetween which shades light and therefore does not permit light to pass therethrough, said light-shading portion having a second predetermined length along said predetermined path, said second identifying means further comprising light detecting means for emitting light toward said light-shading member and detecting said slits by receiving the light having passed through said slits and the light-shading portions alternate with said slits along said predetermined path by not receiving the light emitted toward the light-shading member, said generating means generating a first signal each time said light detecting means detects each of said slits, and generating a second signal different from said first signal each time said light detecting means detects each of said light-shading portions, said identifying means identifying that said cutting member has been displaced by said predetermined amount of distance from said operative position, when said generating means has generated a predetermined number of the first signals after said cutting member has started to displace from said operative position.

10. A work sheet cutting apparatus according to claim 8, wherein said cutting member includes a light-reflecting member having a multiplicity of slits formed at predetermined intervals of distance along said predetermined path, each of said slits permitting light to pass therethrough and having a first predetermined length along said predetermined path, each pair of adjacent two slits out of said multiplicity of slits defining a light-reflecting portion therebetween which reflects light, said light-reflecting portion having a second predetermined length along said predetermined path, said second identifying means further comprising light detecting means for emitting light toward said light-reflecting member and detecting said slits by not receiving the light emitted toward the light-reflecting member and the light-reflecting portions alternate with said slits along said predetermined path by receiving the light reflected by said light-reflecting portions, said generating means generating a first signal each time said light detecting means detects each of said slits, and generating a second signal different from said first signal each time said light detecting means detects each of said light-reflecting portions, said identifying means identifying that said cutting member has been displaced by said predetermined amount of distance from said operative position, when said generating means has generated a predetermined number of the first signals after said cutting member has started to displace from said operative position.

11. A work sheet cutting apparatus according to claim 7, further comprising:

at least one movable member which is movable along a second predetermined path intersecting said predetermined path of said cutting member as a first predetermined path; and inhibiting means for inhibiting said movable member from moving along said second predetermined path while said cutting member is positioned within said predetermined amount of distance from said operative position.

12. A work sheet cutting apparatus according to claim 11, further comprising stitch forming means including a sewing needle, for forming stitches on said work sheet such as a cloth, said at least one movable member comprising needle-thread cutting means for cutting a needle thread conveyed by said sewing needle.

13. A work sheet cutting apparatus for cutting a work sheet, comprising:

a cutting member for cutting said work sheet;

a support member on which said work sheet is to be received when said cutting member is cutting through said work sheet;

actuating means for displacing said cutting member along a predetermined path between an operative position of said cutting member where said cutting member is received by said support member and a retracted position of said cutting member spaced away from said operative position;

detecting means for continuously detecting the displacement of said cutting member within a predetermined range included in said predetermined path, and generating continuous signals representing that said cutting member is displacing within said predetermined range, said predetermined range including said operative position of said cutting member; and first identifying means for identifying, based on the generated continuous signals, whether said displacement of said cutting member has been stopped at said operative position of the cutting member, wherein said predetermined range including said operative position of said cutting member is divided into a multiplicity of divided portions which are contiguous with each other, said detecting means comprising generating means for generating said continuous signals, said generating means generating, each time said cutting member enters each of said divided portions of said predetermined range while displacing toward said operative position along said predetermined path, a corresponding one of said continuous signals, said identifying means identifying that said displacement of said cutting member has been stopped at said operative position, when said generating means does not generate said corresponding one signal for said each divided portion for a time duration predetermined for said each divided portion after said generating means has generated the signal for a backward adjacent divided portion out of said continuous divided portions.

14. A work sheet cutting apparatus for cutting a work sheet, comprising:

a cutting member for cutting said work sheet;

a support member on which said work sheet is to be received when said cutting member is cutting through said work sheet;

actuating means for displacing said cutting member along a predetermined path between an operative position of said cutting member where said cutting member is received by said support member and a retracted position of said cutting member spaced away from said operative position;

detecting means for continuously detecting the displacement of said cutting member within a predetermined range included in said predetermined path, and generating continuous signals representing that said cutting member is displacing within said predetermined range, said predetermined range including said operative position of said cutting member;

first identifying means for identifying, based on the generated continuous signals, whether said displacement of said cutting member has been stopped at said operative position of the cutting member; and second identifying means for identifying, based on the generated continuous signals, whether said cutting member has been displaced by a predetermined distance from said operative position of the cutting member.

15. A work sheet cutting apparatus for cutting a work sheet, comprising:

a cutting member for cutting said work sheet;

a support member on which said work sheet is to be received when said cutting member is cutting through said work sheet;

actuating means for displacing said cutting member along a predetermined path between an operative position of said cutting member where said cutting member is received by said support member and a retracted position of said cutting member spaced away from said operative position;

detecting means for continuously detecting the displacement of said cutting member within a predetermined range included in said predetermined path, and generating continuous signals representing that said cutting member is displacing within said predetermined range, said predetermined range including said operative position of said cutting member; and identifying means for identifying, based on the generated continuous signals, whether said cutting member has been displaced by a predetermined distance from said operative position of the cutting member, wherein said predetermined range including said operative position of said cutting member is divided into a multiplicity of divided portions which are contiguous with each other, said detecting means comprising generating means for generating said continuous signals, said generating means generating, each time said cutting member enters each of said divided portions of said predetermined range while displacing from said operative position along said predetermined path, a corresponding one of said continuous signals, said identifying means identifying that said cutting member has been displaced by said predetermined distance from said operative position, when said generating means has generated a predetermined number of said continuous signals after said cutting member has started to displace from said operative position.

16. A work sheet cutting apparatus for cutting a work sheet, comprising:

a cutting member for cutting said work sheet;

a support member on which said work sheet is to be received when said cutting member is cutting through said work sheet;

actuating means for displacing said cutting member along a predetermined path between an operative position of said cutting member where said cutting is received by said support member and a retracted position of said cutting member spaced away from said operative position;

detecting means for continuously detecting the displacement of said cutting member within a predetermined range included in said predetermined path, and generating continuous signals representing that said cutting member is displacing within said predetermined range, said predetermined range including said operative position of said cutting member;

identifying means for identifying, based on the generated continuous signals, whether said cutting member has been displaced by a predetermined distance from said operative position of the cutting member;

at least one movable member which is movable along a second predetermined path intersecting said predetermined path of said cutting member as a first predetermined path; and inhibiting means for inhibiting said movable member from moving along said second predetermined path while said cutting member is positioned within said predetermined distance from said operative position.

* * * * *